United States Patent [19]

Ciccarelli

[11] 4,146,208

[45] Mar. 27, 1979

[54] MOVABLE BASE JACK

[75] Inventor: William E. Ciccarelli, York, Pa.

[73] Assignee: Union Corporation, Verona, Pa.

[21] Appl. No.: 787,570

[22] Filed: Apr. 14, 1977

[51] Int. Cl.[2] ..... B66F 3/38

[52] U.S. Cl. ..... 254/85; 254/101; 254/DIG. 1

[58] Field of Search ..... 254/DIG. 1, 2 R, 84–85, 254/101

[56] References Cited

U.S. PATENT DOCUMENTS 3,734,465 5/1973 Patchen et al. ..... 254/84

FOREIGN PATENT DOCUMENTS 294665 3/1932 Italy ..... 254/DIG. 1

*Primary Examiner*—Robert C. Watson

*Attorney, Agent, or Firm*—Fleit & Jacobson

[57] ABSTRACT

A movable base jack includes a jack pad, a guideway integrally connected to the pad and a jack column connected to a wheel assembly which rolls in the guideway. The wheel assembly can move in a longitudinal, rotational and arcuate direction in the guideway and is captivated to the pad.

13 Claims, 10 Drawing Figures

30
26
28
13
12

10
4
29
44
48
135
133
131
6
104
68
68
84
84
8
62
62
67
60
82
82
2

MOVABLE BASE JACK

BACKGROUND OF THE INVENTION

This invention relates to a movable base jack. More particularly, this invention relates to a movable base jack in which the lift member is connected to a wheel assembly which rolls in a guideway attached to the jack pad. The movable base jack of this invention has particular utility as a positioning and levelling jack for supporting shelter units in a level position regardless of the terrain.

Various portable hand-operated machines for lifting heavy weights or otherwise exerting great force by utilizing the principle of the lever, screw, toggle joint or hydraulic press are well known in the prior art. Also known in the art are levelling jacks with movable bases for positioning the jack directly below the load, such as a shelter unit, to be lifted. By utilizing a movable base on the jack, the lift member of the jack and the object to be lifted can be maintained in a perpendicular relation. In this manner, purely vertical forces are exerted on the weight such that the jack is operating at maximum efficiency and the load to be lifted, such as a shelter unit, is maintained level.

However, many of these prior art devices can only move in one planar direction. Also, many of these devices are inefficient due to the high friction losses experienced in moving the jack within its base. An example of this latter type device can be seen in commonly-owned U.S. Pat. No. 3,604,166 in which the sliding jack is subject to high friction loading due to sand or dirt entrapped within the slide trough. Further, the jack mounting is subject to high moment loads.

SUMMARY OF THE INVENTION

The present invention is broadly directed to a movable base jack in which the jack column is connected to a wheel assembly which rides in a guideway integrally attached to a jack pad. The guideway is disposed centrally of the pad and comprises an arcuate concave surface for the roller assembly to ride on which terminates into a pair of outwardly extending ridges. The guideway also includes a pair of upstanding parallel flanges which terminate at their upper ends with a pair of inwardly extending flanges.

The wheel assembly includes an inverted U-shaped caster housing attached at its upper end to the jack column and having outwardly diverging flanges at its lower extremities. Mounted within the housing is a wheel which rotates by means of bearings on an axle fixedly attached to both ends of the caster housing. The perphery of the wheel cross-section is of the same arcuate shape as the arcuate surface of the guideway but shaped convexly and rides on the guideway. The jack column may be any suitable jack structure such as a jackscrew threadably attached to a load support in which the jackscrew is mounted within a bore in an upper closure cap of a tubular member. The tubular member is slotted to receive the load support and is attached to the wheel assembly by means to be described.

Within the guideway, the wheel assembly can move in a longitudinal, rotational, and angular direction to align the jack column and load support with the load to be raised. As the load is being moved in a vertical direction, the roller assembly rolls within the guideway to prevent undue stresses on the jack column and to assure a vertical position of the jack column for maximum efficiency.

The invention also relates to the use of the movable base jacks as levelling jacks for shelter units. Shelter units in the form of rigid enclosures, as shown in U.S. Pat. No. 3,604,166, have been employed for various equipment such as communication equipment and the like. Such shelter units may be deployed by various means of transportation including aircraft, helicopters, trucks or detachable running gears, and each shelter is provided with levelling jacks preferably mounted on the corner thereof for enabling the shelter to be levelled when deployed on uneven terrain.

Thus, it is an object of this invention to provide a movable base jack mounted to a shelter unit to enable the shelter unit to be level.

Such shelter units must frequently be moved after deployment on the ground into a position such that two shelter units are united to form an expanded unit. It is an object of this invention to provide a shelter unit with movable base jacks whereby the shelter unit can be moved a given distance depending on the limits that the wheel assembly of the movable base jack can move with respect to the jack pad.

In view of the foregoing, an object of the present invention is to provide an improved movable base jack.

A further object of the present invention is to provide a movable base jack so that a load supported by the jack structure may be moved in relation to the jack pad without damage to the jack structure while the relationship between the jack structure and the load supported thereby remains the same.

Yet another object of the present invention is to provide a movable base jack in which the jack can easily roll on a captivated guideway incorporated as part of the jack pad.

A still further object of the present invention is to provide a movable base jack in which the jack is not subject to high friction forces during movement within its base.

A yet further object of the present invention is to provide a movable base jack in which the wheel assembly is not sensitive to dust and dirt.

Yet another object of the present invention is to provide a movable base jack in which the wheel assembly can rotate so that 360° of pad orientation may be achieved.

Still another object of the present invention is to provide a movable base jack in which the wheel assembly can be made captive to the pad and removed from the jack column.

A still further object of the present invention is to provide a movable base jack in which the jack pad can be oriented laterally and move longitudinally to follow the local terrain.

Yet another object of the present invention is to provide a movable base jack in which the size of the jack pad is capable of modification to comply with any specified ground bearing pressures.

A further object of the present invention is to provide a movable base jack which is easy to attach, simple in construction, efficient for its particular purposes and relatively inexpensive to manufacture.

Still further objects of the present invention will become apparent upon reading the following description taken in conjunction with the appended claims.

DESCRIPTION OF THE PREFERRED EMBODIMENTS

Figure 1:
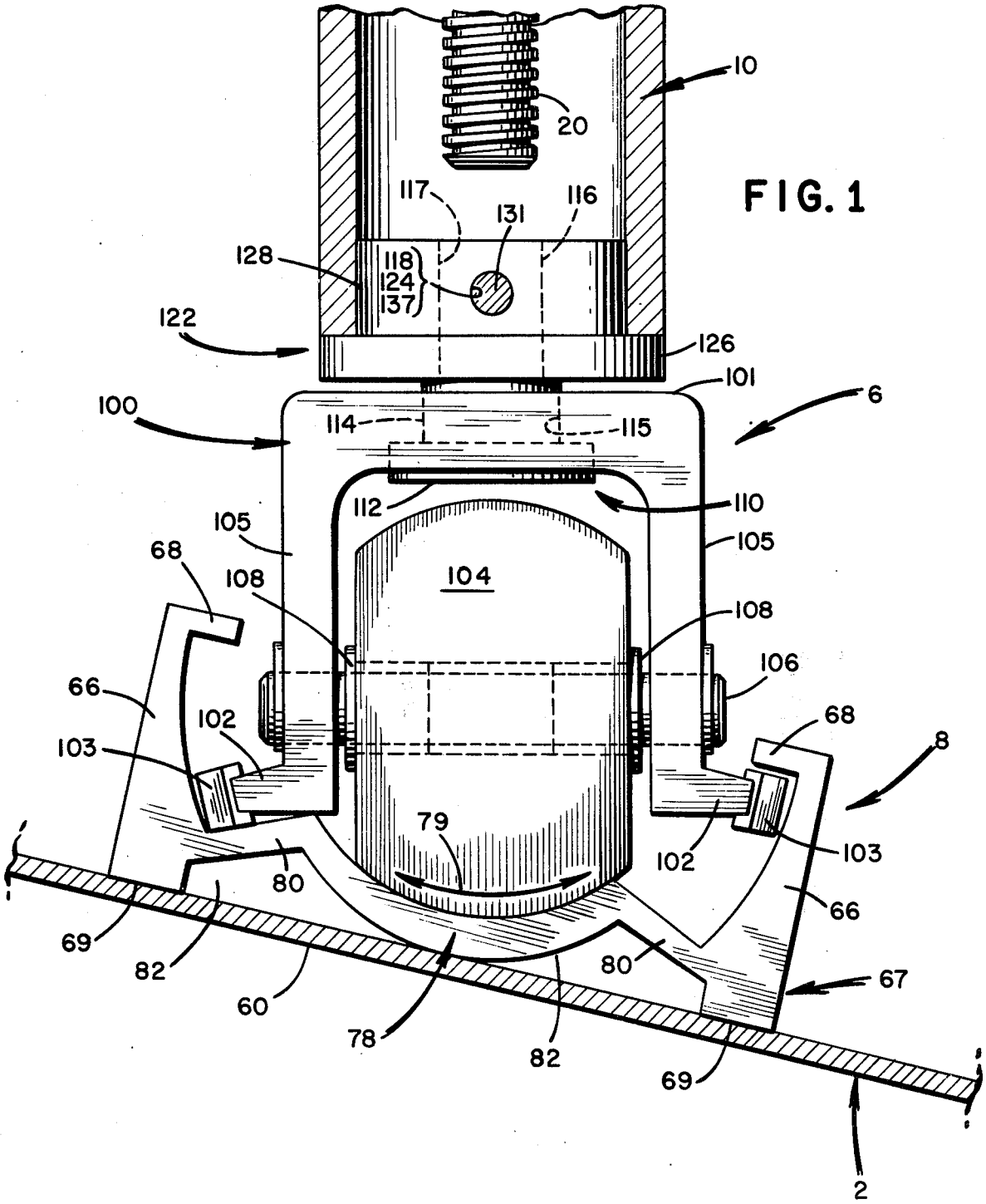
FIG. 1 is an exploded vertical sectional view illustrating the jack pad, guideway and wheel assembly and the association of these components with each other.
Figure 2:
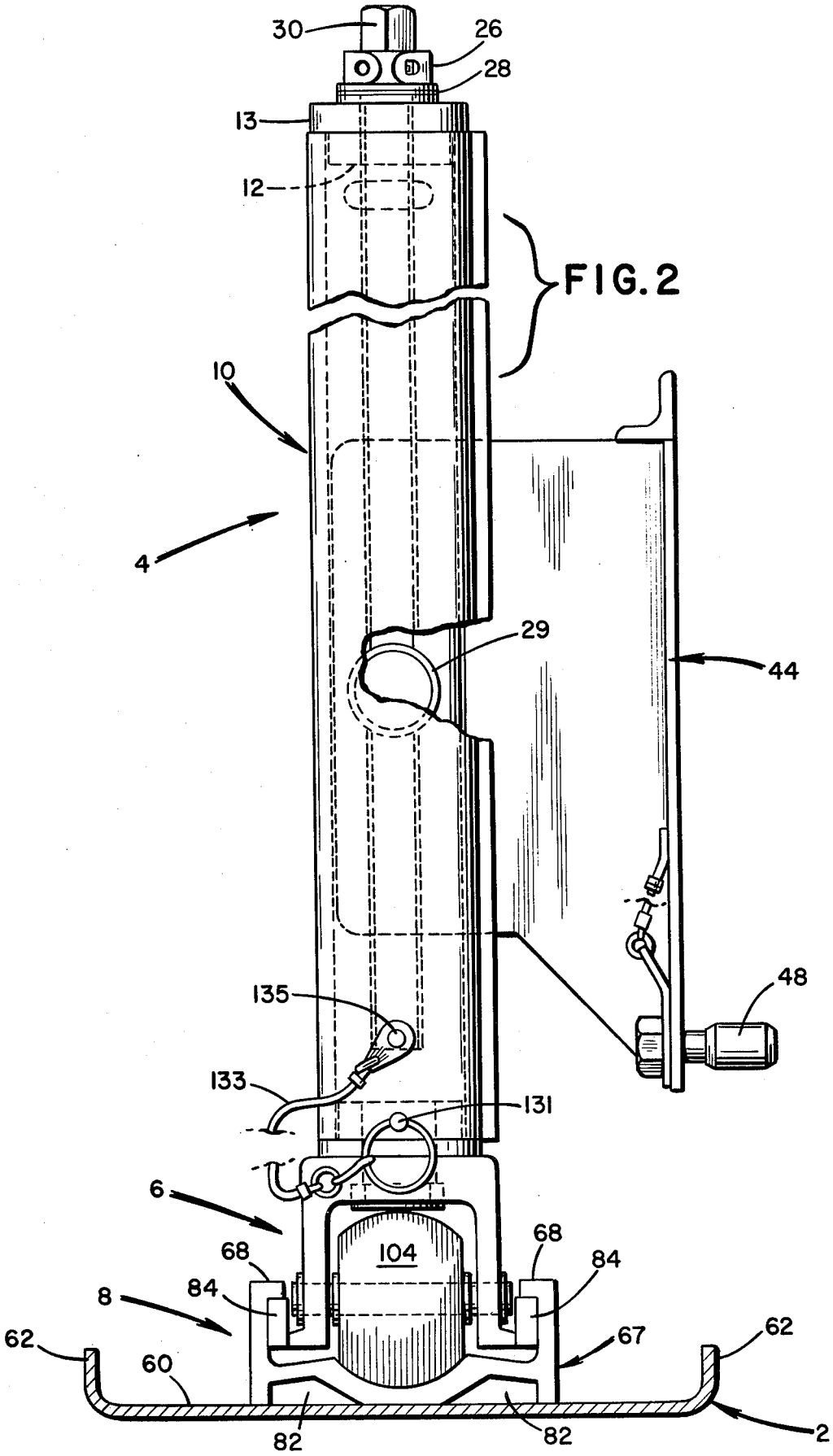
FIG. 2 is a vertical sectional view of the jack taken along its longitudinal direction.
Figure 3:
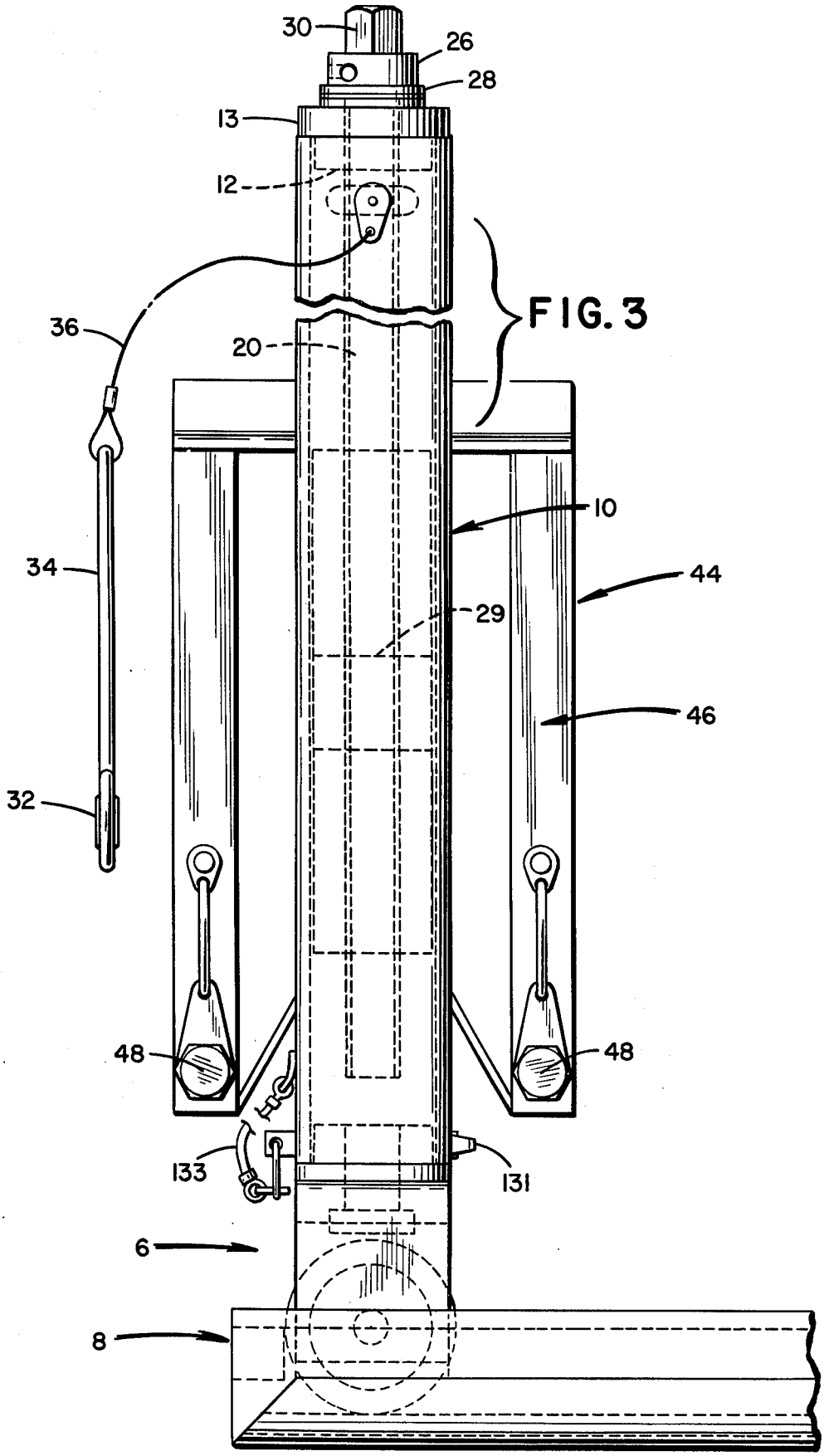
FIG. 3 is a vertical sectional view of the jack taken along its lateral direction.
Figure 4:
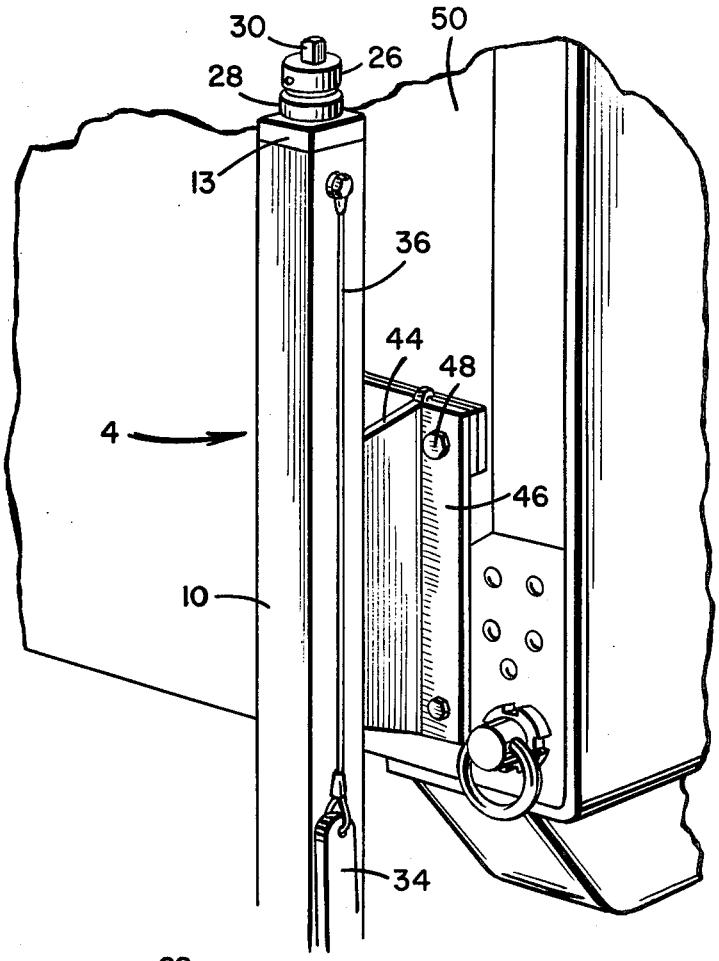
FIG. 4 is a perspective view of the jack column illustrating its association with a corner of a shelter unit.

Referring to the drawings, the movable base jack includes a jack column 4, wheel assembly 6, jack pad 2, and guideway 8 integrally connected to jack pad 2. Jack pad 2 includes an elongated generally rectangular plate 60, which could be of a magnesium or aluminum extrusion having upturned flanges 62 at each longitudinal side edge thereof, the dimensions of plate 60 varying with the requisite ground bearing pressure with an optimum maximum pressure of 6 p.s.i.

Disposed centrally of the plate 60 is an elongated guideway 8 securely attached thereto and comprising a pair of parallel upstanding flanges 66 which terminate at their upper edges with inturned flanges 68 extending toward each other. At their lower ends, the upstanding flanges 66 are mounted to a base portion 67 of the guideway 8. The base portion 67 can be integrally connected with the jack pad 2 by a permanent connection with the plate 60 at points 69. The base portion 67 of the guideway 8 provides an elongated concave arcuate track 78, for receiving wheel 104, which terminates into a pair of outwardly extending ridges 80 within guideway 8. Ridges 80, on each side of track 78, terminate into upstanding flanges 66. A relief 82 can be formed on each side of arcuate track 78, extending the length of the guideway 8 and defined by ridges 80, arcuate track 78, rectangular plate 60 and upstanding flanges 66.

Thus, the arcuate track 78, ridges 80, flanges 66 and flanges 68 provide a channel for receiving wheel assembly 6 for longitudinal, rotational and arcuate movement therein. Additionally, wheel assembly 6 is prevented from escaping guideway by a pair of removable stopping elements 84 at one end of guideway 8, and fixedly attached stopping elements 85 at the other end of guideway 8. The stopping elements 84 and 85 are of any suitable material such as metal or plastic, and elements 84 are releasably retained by screws or the like in the corners defined by flanges 66 and inwardly extending flanges 68.

Referring to FIG. 1, wheel assembly 6 includes inverted U-shaped bracket caster housing 100 having an upper horizontal surface, or mounting plate 101, with two parallel legs 105 extending downwardly therefrom. Outwardly projecting edges 102, at the lower extremities of the legs 105, are confined arcuately by the ridges 80, vertically by the flanges 68 and horizontally by the flanges 66 of guideway 8. Attached to edges 102 are protecting strips 103, of a suitable material such as vinyl or plastic, such that guideway 8 is protected from the cutting effect of edges 102.

Caster housing 100 also includes a centrally located bore, or hole, 115 at its upper horizontal surface 101 in which a connecting bolt 110 is rotatably journalled. Connecting bolt 110 includes a head 112 which is larger than the bore, a neck 114 which pivotally inserts into the bore, and a narrow shank 116 with a pin hole 118 therein. Horizontal surface 101 further includes a concentric head receiving bore 119 for receiving the bolt head 112. Bolt 110 is inserted up through the bore 115 in caster housing 100. Shank 116 is then fixedly engaged by a press-fit into column support block 122 such that the pin hole 124 in the column support 122 is aligned with pin hole 118 of the narrow shank 116. Column support block 122 includes a body 128 of circular cross-section and a base 126 of larger diameter than body 128. A support block hole 117 extending along the axis of the jack column is provided. Tubular member 10 is inserted over the body 128 and rests upon base 126. Tubular member 10 has a pin hole 137 near its lower, open end such that when member 10 is resting on base 126, pin holes 118, 124 and 137 are all aligned and pin 131 is inserted thereinto. Thus, when jack column 4 is supporting a load, wheel assembly 6 can pivot or rotate about bolt 112.

Figure 10:
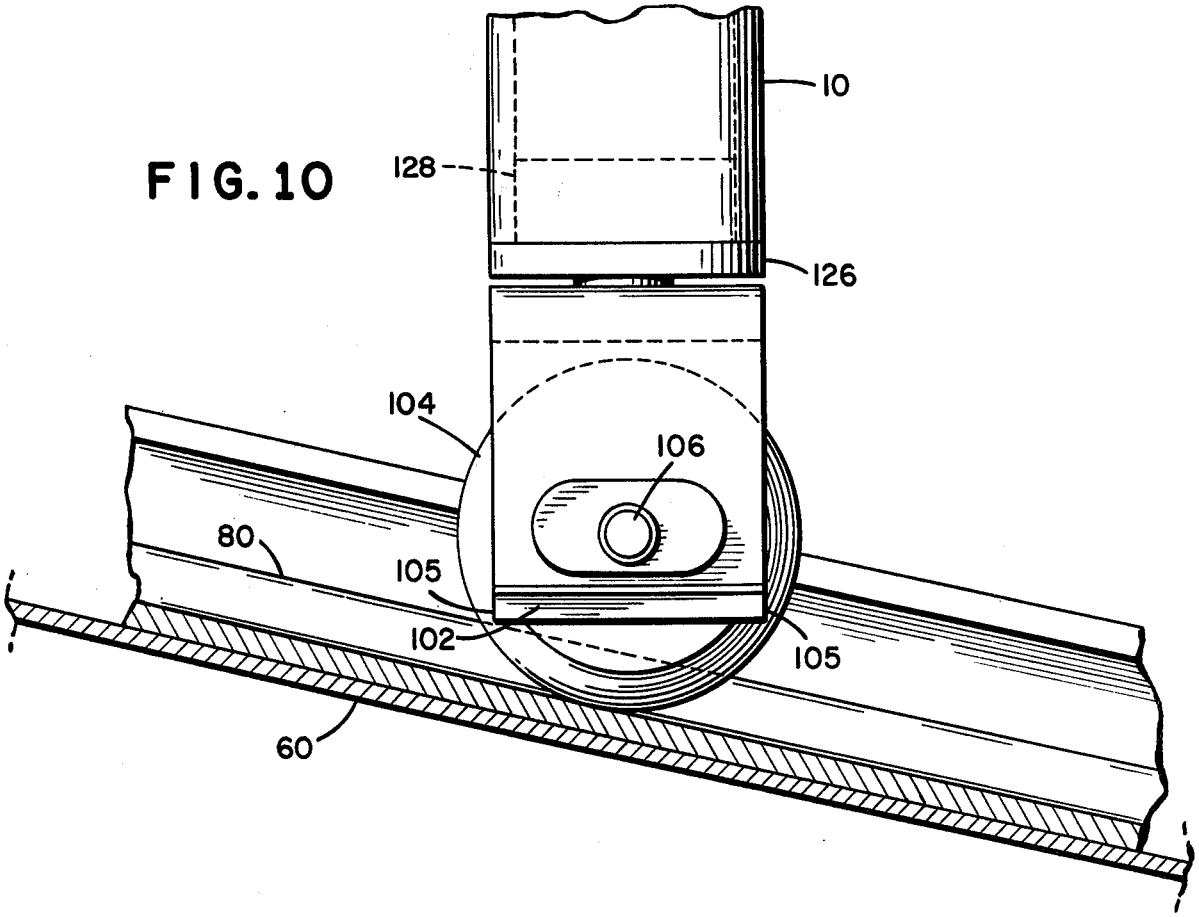
FIG. 10 is a vertical sectional view of the jack of FIG. 3 illustrating the arcuate limitation of the jack in the longitudinal direction.

Associated with and mounted within housing 100 is a wheel 104 which rotates by means of bearings 108 on axle 106 wherein axle 106 is fixedly mounted to the legs of caster housing 100 by any suitable means and extends perpendicularly between the two legs. The wheel is made from an aluminum or magnesium alloy. Also, the peripheral cross-section of wheel 104 is of the same arcuate shape as track 78 and rides thereon. The wheel 104 can rotate about its axle 106, and can also slide arcuately with respect to the track 78 as shown by the arrow 79 in FIG. 1. In this manner, jack pad 2 can be oriented laterally as shown in FIG. 1, to account for local terrain, preferably at a fifteen degree arc, in which jack pad 2 is limited in its lateral movement by protruding edges 102 abutting ridges 80. Also, jack pad 2 can move longitudinally in an arcuate movement to account for local terrain and is limited in this longitudinal movement by the ends 105 of protruding edges 102 abutting ridges 80, as shown in FIG. 10.

Figure 5:
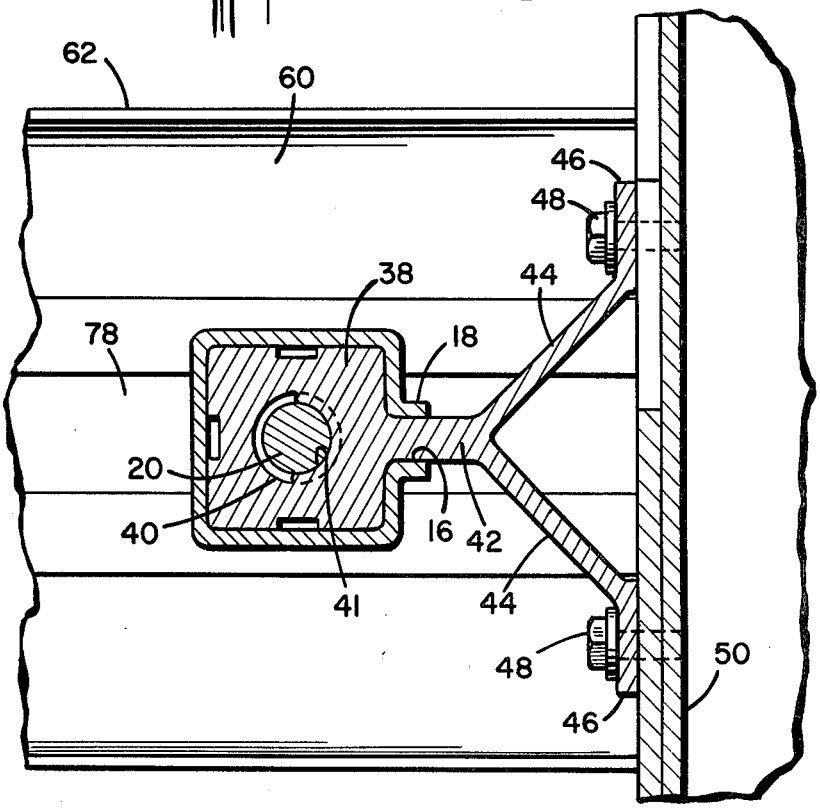
FIG. 5 is a transverse, sectional view taken substantially upon a plane passing along section line 5—5 of FIG. 6 illustrating further structural details of the jack and the attaching bracket structure.
Figure 6:
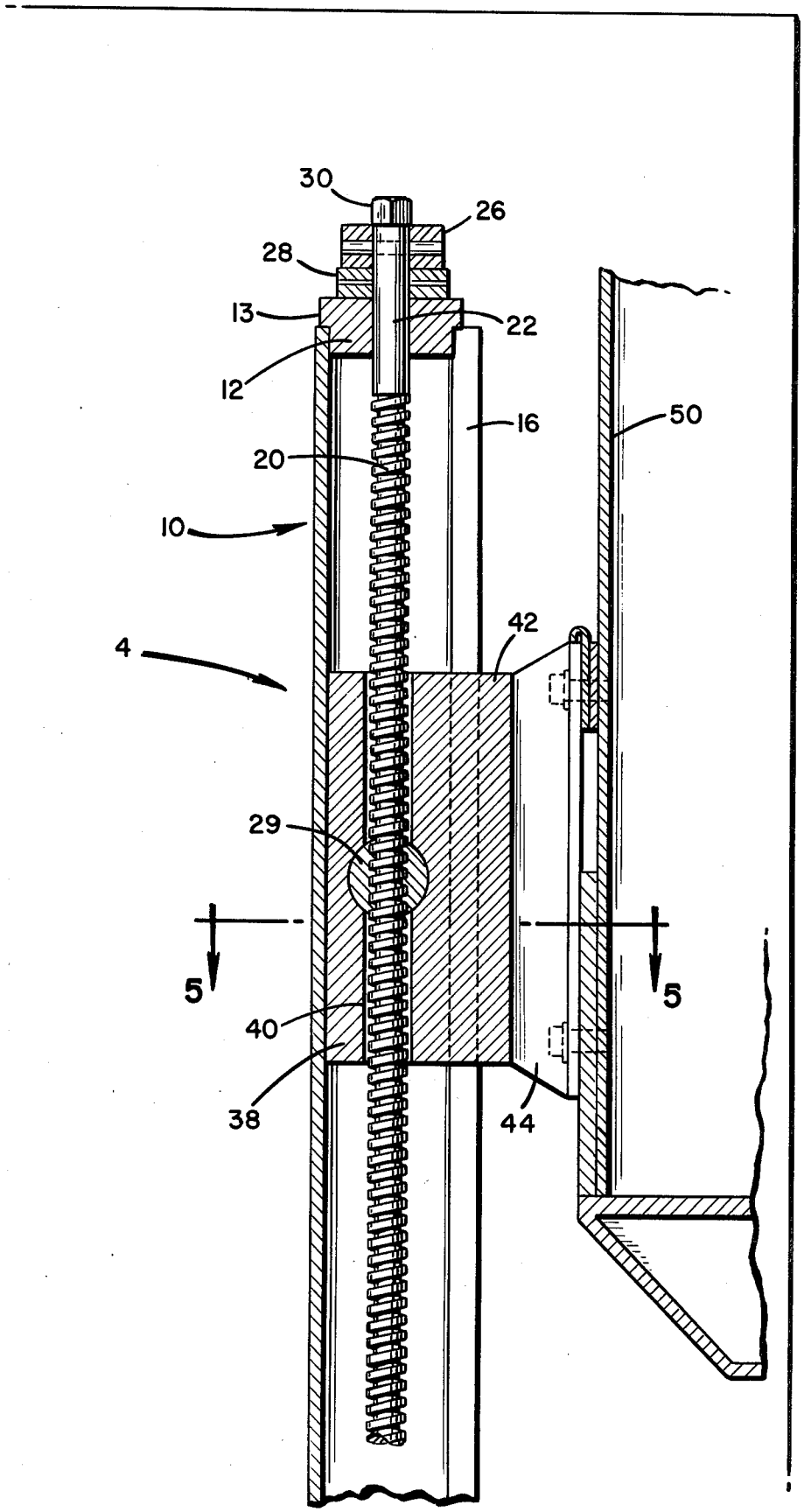
FIG. 6 is a vertical sectional view of the jack FIG. 2 illustrating the specific structural details of the jack column.
Figure 7:
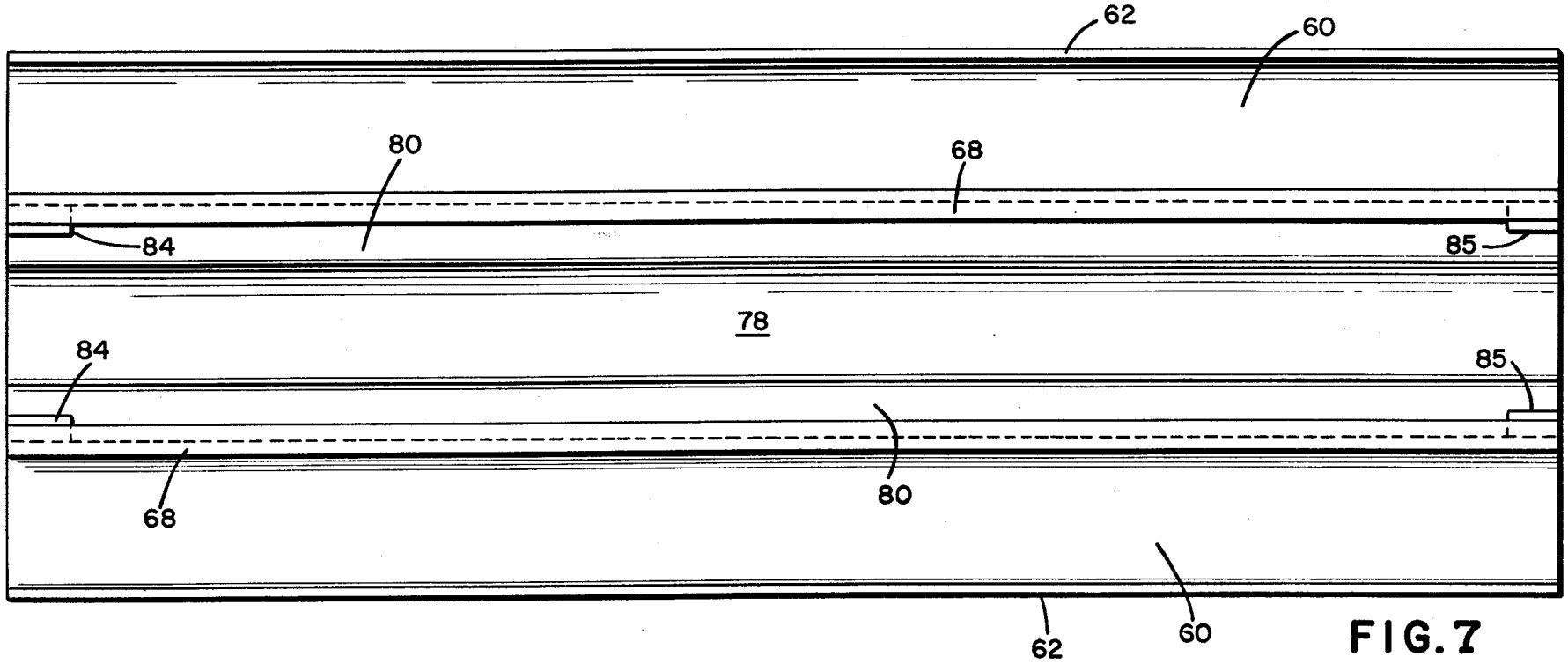
FIG. 7 is a top plan view of the jack pad and guideway.
Figure 8:
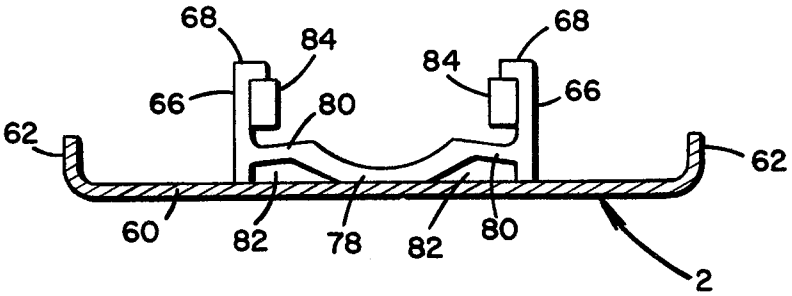
FIG. 8 is a vertical, sectional view of the jack pad and guideway as shown in FIG. 2.

Referring to FIG. 6, jack column 4 includes a tubular member 10 which may be of any suitable configuration such as substantially square or round. Tubular member 10 is provided with an elongated longitudinal slot 16 defined by outwardly extending parallel flanges 18, as shown in FIG. 5. Both upper and lower ends of tubular member 10 are open.

The upper end of tubular member 10 is provided with a closure cap 12 which fits snugly within tubular member 10 and has an upper rim 13 of larger diameter than the inner diameter of member 10 and rests upon member 10. Near the lower end of tubular member 10 is a pin 131 attached to member 10 by any suitable means such as lanyard 133 and bolt 135. The tubular member 10 or column serves as the load carrying element of the jack assembly and is of sufficient cross section to withstand the vehical and side loads and moments encountered in the operation of the jack assembly.

Disposed rotatably within the tubular member 10 is an elongated screwthreaded member 20 having an unthreaded upper end portion 22 journalled in a bore in the upper closure cap 12. In that the jack screw 20 sees only tensile loads since the screw is suspended from the top of the column (10) it can be smaller in diameter since it is free from columnar loading. The suspended screw technique thus results in a lighter weight assembly.

Rigidly fixed to the upper end of the unthreaded portion 22 of the jackscrew 20 is a rigid collar 26 with a thrust bearing assembly 28 of any suitable configuration and construction being disposed between the collar 26 and the upper end 13 of the closure cap 12, thereby supporting and rotatably journalling the jackscrew 20 from the upper end of the tubular member 10, with the lower end of the jackscrew 20 being spaced above the lower end of the tubular member 10 and free thereof. A polygonal axial projection 30, preferably a steel hex head, is provided on the upper end of the jackscrew 20 for receiving a socketed driving element 32 of a conventional ratchet wrench 34 tethered to the tube 10 by a flexible lanyard 36 or the like, to facilitate rotation of the jackscrew.

Threaded onto the jackscrew 20 is an elongated guide 38 that includes a journaled bore 40 of larger diameter than jackscrew 20 and a barrel nut 29 with a screwthreaded bore 41 for receiving the jackscrew 20. The screwthreaded bore of the barrel nut 29 is aligned with bore 40 and barrel nut 29 is fixed within guide 38. Also, as illustrated in FIG. 5, the guide 38 closely sits within the interior of the tubular member 10 thus providing substantial lateral stability to the jack structure. Guide 38 also includes a laterally extending flange 42, extending the length of guide 38 and through the slot 16 and terminating in outwardly diverging longitudinal plates 44. Plates 44 terminate in attaching frame 46 which is secured to the shelter unit 50 or other load to be supported by bolts 48 or the like.

Turning now to the operation of the movable base jack, wheel assembly 6 is inserted into guideway 8 such that wheel 104 rolls on track 78. Stops 84 are then secured to guideway 8 to prevent wheel assembly 6 from escaping guideway 8. By utilizing a wheel assembly 6 as described, a movable base jack is provided in which the jack can easily roll on a captivated guideway incorporated as part of the jack pad in which the high friction forces normally encountered in the prior art devices are removed and where the wheel assembly 6 can move in a longitudinal, pivotal, longitudinal arcuate and lateral arcuate direction.

Thereafter, jack column 2 and specifically tubular member 10, is inserted over column support 122 and rests upon base 126 of support 122. Pin holes 118, 124 and 137 are then aligned whereupon pin 131 is inserted, thus providing a unitary movable base jack.

Figure 9:
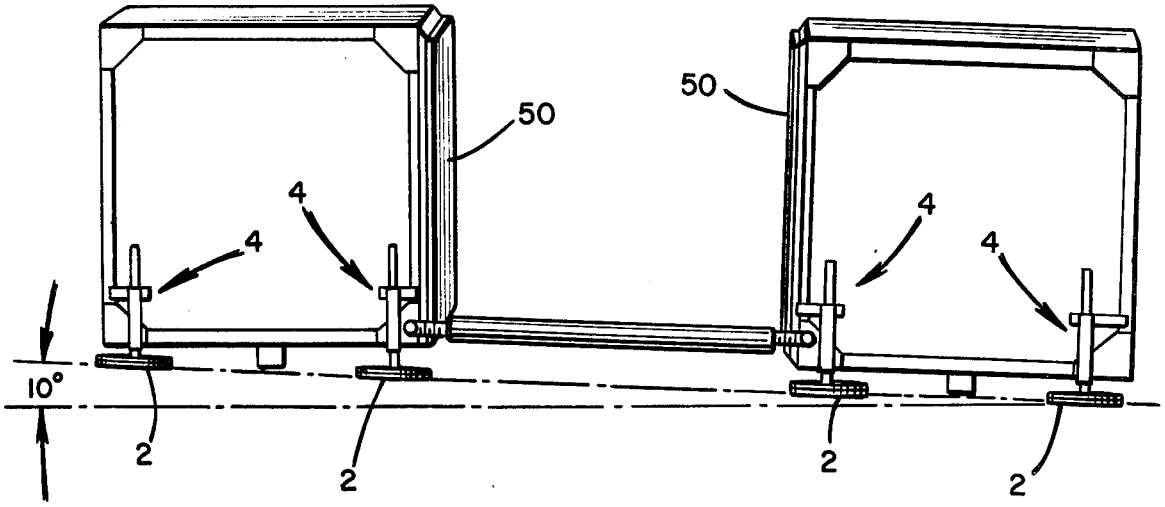
FIG. 9 is a perspective view of the attachment and levelling of a plurality of shelter units.

Upon assembly of the jack, the movable base jack is positioned near shelter unit 50 and jack pad 2 and wheel assembly 6 are oriented in the appropriate direction. Bolts 48 are then secured in the frame of shelter unit 50. After jacks have been attached to all four corners of the shelter unit, hex nut 30 is rotated by ratchet wrench 34 such that jackscrew 20 is rotated, causing barrel nut 29, guide 38, plates 44, and shelter unit 50 to be raised or lowered. In this manner, shelter units 50 can be leveled and aligned with each other as shown in FIG. 9 and described more fully in commonly owned U.S. Pat. No. 3,604,166.

The jack pad 2 and wheel assembly 6 can also be removed from the tubular member 10 by removing the pin 131, and then moving tubular member 10 and the column support block 122 with respect to each other.

Thus, a movable base jack is provided which is easy to attach and simple in construction and which may be moved in relation to the jack pad without damage to the jack structure while the relationship between the jack column and the load to be supported remains the same.

While one embodiment of the present invention has been described above, it will be appreciated that there are many modifications and changes which can be made within the scope of the present invention. For example, jack column 2 can be replaced by a system in which a threaded jack screw is attached to column support 122. Utilizing this system, a tubular member, with threaded closure caps at both ends, is screwed onto the jackscrew and the shelter unit is attached to the tubular member. Accordingly, the present invention should not be limited by the specific embodiments illustrated, but only as defined in the appended claims.

I claim:

1. A movable base jack comprising:

a jack pad, guideway integrally connected with said jack pad, a wheel assembly positioned within said guideway, said wheel assembly comprising a wheel engaging said guideway and supported by said guideway, wherein said guideway includes means for angularly adjusting the wheel and guideway with respect to each other, a jack column, and attaching means for attaching the wheel assembly to said jack column, wherein said wheel assembly is adapted to roll in said guideway and wherein said jack column and said jack pad can be angularly adjusted with respect to each other.

2. The movable base jack of claim 1 werein said wheel assembly includes a caster housing, a wheel mounted on an axle, said axle attached to said caster housing wherein said wheel assembly can move within said guideway.

3. The movable base jack of claim 2 wherein said caster housing comprises a U-shaped bracket having a mounting plate and two parallel legs extending from the ends of said mounting plate, said axle mounted perpendicular to, and extending between, the two parallel legs, said wheel rotatable about said axle.

4. A movable base jack comprising:

a jack pad, a guideway integrally connected with said jack pad, a wheel assembly positioned within said guideway, wherein said wheel assembly includes a caster housing, a wheel mounted on an axle, and wherein said caster housing comprises a U-shaped bracket having a mounting plate and two parallel legs extending from the ends of said mounting plate, said axle mounted perpendicular to, and extending between, the two parallel legs, said wheel rotatable about said axle, a jack column, and attaching means for attaching the wheel assembly to said jack column, wherein said wheel assembly is adapted to roll in said guideway, said attaching means comprises a support block mounted at one end of said jack column, said support block having a support block hole extending therethrough, said support block hole extending along the axis of said jack column, said mounting plate having a mounting plate hole, a connecting bolt extending through the mounting plate hole and the support block hole and fixedly engaged to said support block, said mounting plate freely rotatable about said connecting bolt, and means for releasably securing said support block within said jack column.

5. The movable base jack of claim 4 wherein said means for releasably securing said support block within said jack column comprises a removable pin extending transversely to the axis of said jack column and extending through the jack column, the support block, and the connecting bolt, whereby removal of the removable pin enables the support block and jack column to be separated from each other.

6. A movable base jack comprising:

a jack pad, a guideway integrally connected with said jack pad, a wheel assembly positioned within said guideway, wherein said wheel assembly includes a caster housing, a wheel mounted on an axle, said axle attached to said caster housing wherein said wheel assembly can move within said guideway, a jack column, and attaching means for attaching the wheel assembly to said jack column, wherein said wheel assembly is adapted to roll in said guideway, wherein said guideway comprises a base portion integrally connected to said jack pad, said base portion having an elongated track means for receiving and guiding the wheel, said track means having a concave cross-section, said wheel having a corresponding convex cross-section so that said wheel and said jack pad can move angularly with respect to each other by said convex wheel arcuately sliding with respect to said concave track means.

7. The movable base jack of claim 6 wherein the radii of curvature of the concave cross-section of said track means and the convex cross-section of the wheel are equal.

8. The movable base jack of claim 6 wherein the concave cross-section of said track is wider than the convex cross-section of said wheel.

9. A movable base jack comprising:

a jack pad, a guideway integrally connected with said jack pad, a wheel assembly positioned within said guideway, wherein said wheel assembly includes a caster housing, a wheel mounted on an axle, and wherein said caster housing comprises a U-shaped bracket having a mounting plate and two parallel legs extending from the ends of said mounting plate, said axle mounted perpendicular to, and extending between, the two parallel legs, said wheel rotatable about said axle, a jack column, and attaching means for attaching the wheel assembly to said jack column, wherein said wheel assembly is adapted to roll in said guideway, said guideway comprises a base portion integrally connected to said jack pad, said base portion having an elongated track means for receiving and guiding the wheel, said track means having a concave cross-section, said wheel having a corresponding convex cross-section so that said wheel and said jack pad can move angularly with respect to each other by said convex wheel arcuately sliding with respect to said concave track means.

10. The movable base jack of claim 9 wherein said concave track means terminates into a pair of outwardly extending ridges on each side thereof and said caster housing further comprises a pair of outwardly extending flanges, each flange mounted at the lower extremities of said two parallel legs, wherein said outwardly extending flanges limit the angular movement of the wheel assembly in said guideway by abutting said outwardly extending ridges.

11. The movable base jack of claim 10 wherein said guideway includes a pair of longitudinal parallel upstanding flanges mounted to said base portion, said upstanding flanges terminating with inturned flanges along their upper edges to confine said wheel assembly within said guideway.

12. The movable base jack of claim 1 wherein said jack pad has an area such that the force exerted on said pad results in a pressure not greater than 6 psi.

13. The movable base jack of claim 11 wherein one end of said guideway comprises a first pair of stopping elements each fixedly attached within said guideway where the upstanding flange terminates with the inturned flange, and the other end of said guideway comprises a second pair of stopping elements each removably attached within said guideway where the upstanding flange terminates with the inturned flange, the removal of said second pair of stopping elements permits the wheel assembly to be removed from the guideway.

* * * * *